United States Patent [19]

Loeffler

[11] 4,102,476

[45] Jul. 25, 1978

[54] SQUEEZE BOTTLE DISPENSER WITH AIR CHECK VALVE ON COVER

[75] Inventor: Herbert H. Loeffler, Arlington, Mass.

[73] Assignee: Ciba-Geigy Corporation, Ardsley, N.Y.

[21] Appl. No.: 770,759

[22] Filed: Feb. 22, 1977

[51] Int. Cl.[2] ..... B05B 11/04; B65D 47/34

[52] U.S. Cl. ..... 222/209; 222/212; 239/327

[58] Field of Search ..... 239/327, 533.13, 533.14; 222/209, 211, 212, 494

[56] References Cited

U.S. PATENT DOCUMENTS

| | | | |
|---|---|---|---|
| 3,160,329 | 12/1964 | Radic et al. | 222/212 X |
| 3,176,883 | 4/1965 | Davis, Jr. | 239/327 X |
| 3,189,282 | 6/1965 | Corsette | 239/327 |
| 3,223,289 | 12/1965 | Bouet | 222/209 |
| 3,794,247 | 2/1974 | Corsette | 222/211 X |

*Primary Examiner*—Robert B. Reeves
*Assistant Examiner*—David A. Scherbel

[57] ABSTRACT

A squeeze bottle type dispenser has a resiliently collapsible container for the liquid to be dispensed. A cover on the container, said cover means has a flexible resilient central portion flexible outwardly of the cover away from the container. A dispensing valve member on the cover has a dispensing orifice therein, and an interior surface facing into the container. A dispensing valve body is fixed in position within the container adjacent the cover and has an exterior surface complementary in shape to that of the interior surface of the dispensing valve member and with which the interior surface of the valve member tightly engages when the parts of the dispenser are in the non-dispensing positions. The interior of the valve body is hollow and the valve body has product dispensing apertures opening from the hollow interior through the exterior surface thereof and which are normally covered by the valve member when the parts of the dispenser are in the non-dispensing positions. The dispenser has an air return flow path therethrough and a valve therein opening the air return flow path when the pressure on the outside of the container is greater than the pressure on the inside of the container. A dip tube or a collapsible bag within the container is connected to the valve body for delivering liquid to the hollow interior of the valve body when the container is collapsed.

7 Claims, 4 Drawing Figures

SQUEEZE BOTTLE DISPENSER WITH AIR CHECK VALVE ON COVER

BACKGROUND OF THE INVENTION AND PRIOR ART

This invention relates to a squeeze bottle dispenser, and more particularly relates to a squeeze bottle dispenser having a minimum number of parts, yet which produces an extremely well atomized spray.

The art of squeeze bottle dispensers is extremely well developed. However, these dispensers have become increasingly complex as ways have been sought to improve the ability of the dispensers to dispense well atmoized sprays of liquid, and yet to automatically seal at the end of a dispensing cycle and remain sealed between dispensing cycles.

A typical example of a squeeze bottle dispenser which is an attempt to achieve these objects is shown in U.S. Pat. No. 3,176,883 to Davis, Jr., in which a resiliently collapsible container has a dispensing head thereon through which a dip tube with a check valve therein runs to a dispensing orifice, and which has valving means for permitting one-way flow of air from within the container upwardly to and over the mouth of the dip tube to mix with liquid from the container and flow through the dispensing orifice. An air return passage with a valve therein allows air to flow back with the container after a dispensing cycle. When the bottle is squeezed, the air in the space above the liquid contained therein is compressed, and when sufficient pressure is built up, the liquid flows past the check valve and up the dip tube and the air flow control valve opens and compressed air flows past the valve to the mouth of the dip tube and atomizes the liquid flowing through the dip tube as it passes out through the dispensing orifice.

Thus, the device requires not only a valve member at the foot of the dip tube, as well as a valve member in the air flow path between the interior of the container and the mouth of the dip tube, but also requires a valve in the return air flow passage.

Since this typical squeeze bottle structure requires a large number of parts, including three valves, it is not only relatively expensive to make and sell, but it is not very reliable in operation.

Simplification of such a structure can of course be achieved, but usually at the expense of omitting the function of one or more of the valve members or of parts helping to atomize the liquid.

An example is shown in U.S. Pat. No. 3,474,936 to McDonell, in which the structure has been somewhat simplified, but which still requires three valves, one for the dispensing aperture, one for the return air flow aperture, and one for the foot of the dip tube to completely seal the container between dispensing cycles. When one of the valves is omitted, as in FIG. 9, the interior of the container is always in communication with the atmosphere. Moreover, in the McDonnell dispenser, these valves are spring-loaded valve members, thus requiring additional parts.

On the other hand, the art has recognized the desirability of several features to improve dispensing. For example, the desirability of causing a flow of air to sweep across an aperture through which liquid is flowing to improve atomization of the liquid, such as is shown in U.S. Pat. No. 3,189,282 to Corsette. However, in this patent, the passages for the flow of the liquid and the air are unvalved so that no build up of pressure can occur prior to the start of flow of air or liquid, and separate cover means must be manually positioned to seal the squeeze bottle after each cycle of use.

It would be a distinct advance in the art if there could be provided a squeeze bottle dispenser which has a simplified structure, yet in which the sealing effect and pressure build up effect of the valve means normally provided in the flow paths for the air and the liquid is retained, and which also takes advantage of the improved atomization caused by the sweeping of the air across the aperture through which the liquid is flowing.

OBJECTS AND BRIEF DESCRIPTION OF THE INVENTION

It is accordingly, an object of the present invention to provide a squeeze bottle dispenser which is made of a minimum number of parts, and yet which is completely sealed when not dispensing and which produces extremely good atomization.

It is a further object of the present invention to provide a squeeze bottle dispenser in which the flow passages for both the liquid to be dispensed and the compressed air for atomizing said liquid are automatically closed by a single valve means at the conclusion of the operation of the device.

It is a still further object of the present invention to provide such a squeeze bottle dispenser in which the compressed air is first brought up to a predetermined pressure which will produce good atomization and only then is caused to sweep across the apertures through which the liquid to be dispensed is flowing for improving the atomization.

These objects are achieved, according to the present invention, by a squeeze bottle type dispenser comprising a resiliently collapsible container for the liquid to be dispensed, a cover means on said container, said cover means having a flexible resilient central portion flexible outwardly of the cover means away from the container, a dispensing valve member on said cover having a dispensing orifice therein, and an interior surface facing into said container, a dispensing valve body fixed in position within said container adjacent said cover and having an exterior surface complementary in shape to that of the interior surface of said dispensing valve member and with which the interior surface of said valve member tightly engages when the parts of the dispenser are in the non-dispensing positions, the interior of said valve body being hollow and said valve body having product dispensing apertures opening from said hollow interior through said exterior surface thereof and being normally covered by said valve member when the parts of the dispenser are in the non-dispensing positions, said dispenser having an air return flow path therethrough and valve means therein opening said air return flow path when the pressure on the outside of the container is greater than the pressure on the inside of the container, and liquid delivery means within said container and connected to said valve body for delivering liquid to said hollow interior of said valve body when the container is collapsed. The exterior surface of said dispensing valve body and said dispensing valve member are preferably outwardly conical and said dispensing orifice in said dispensing valve member is at the apex of said dispensing valve member. The product dispensing apertures are preferably substantially transverse to the exterior surface of said dispensing valve member. The liquid delivery means can be either a dip tube or a collapsible bag.

BRIEF DESCRIPTION OF THE DRAWINGS

Other and further objects of the present invention will become apparent from the following description of a preferred embodiment thereof, taken together with the accompanying drawings, in which.

DETAILED DESCRIPTION OF THE INVENTION

Figure 1:
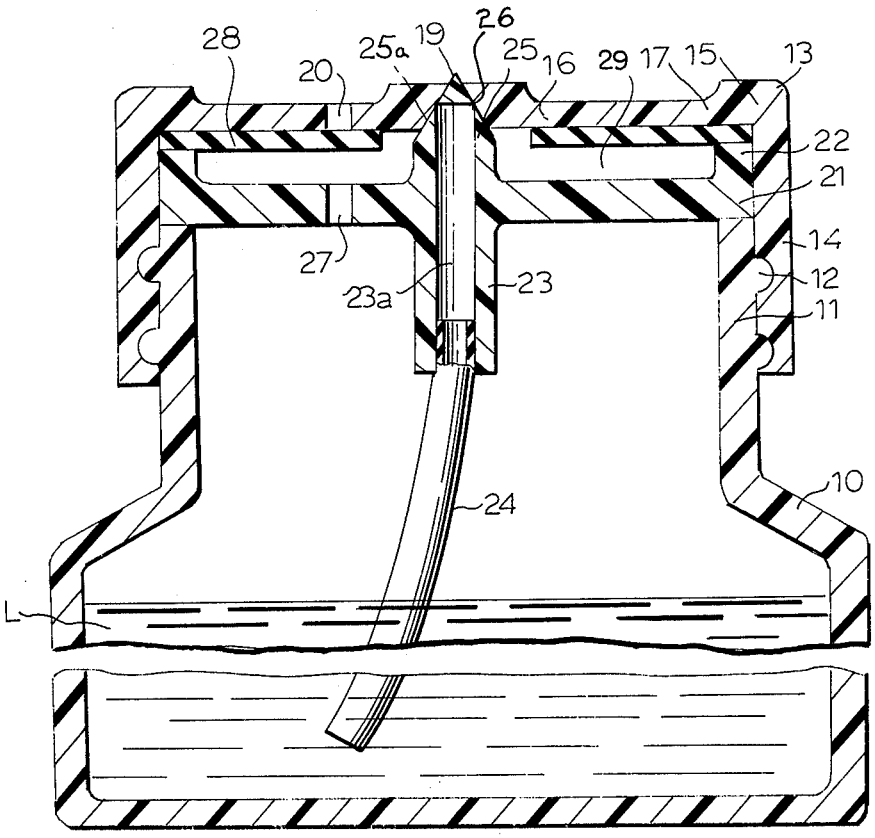
FIG. 1 is a broken sectional elevation view of a first embodiment of a squeeze bottle dispenser according to the present invention with the parts in the rest or non-dispensing position.
Figure 2:
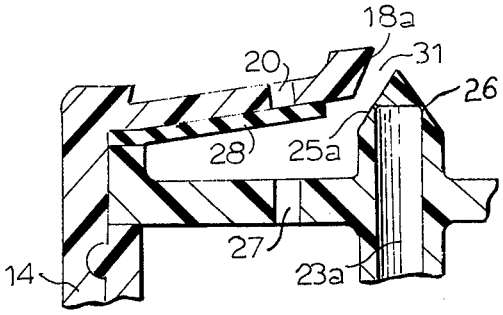
FIG. 2 is a partial sectional view of the dispensing portions of the squeeze bottle of FIG. 1 showing the parts in positions for dispensing the liquid.
Figure 3:
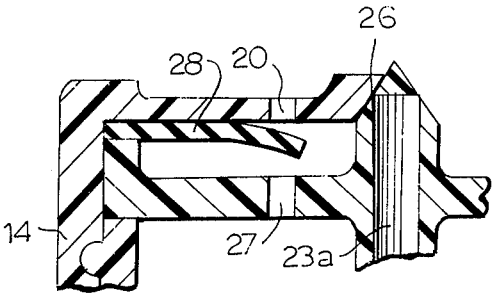
FIG. 3 is a partial sectional view of the squeeze bottle of FIG. 1 showing the parts in positions after conclusion of the dispensing of the liquid and during return air flow.

Referring to FIGS. 1–3, the first embodiment of the present invention is constituted by a resiliently collapsible container 10 made of a material which can be easily squeezed to collapse it, yet which is sufficiently resilient to return to its original shape upon release of any pressure thereon. The container can be made of a plastic material, such as polyethylene or vinyl. In the present embodiment, the material of the container must be inert to a liquid L contained therein and which is to be dispensed.

The container 10 has a neck 11 having threads 12 thereon for attachment of a cover 13 thereto. The threads may be replaced by some other securing means, or the neck can be smooth and the cover bonded to the neck.

The cover 13 has a cylindrical portion 14 with an enlarged rim portion 15 on the outer end thereof, i.e. the end remote from the container 10. A flexible central portion 16 has the periphery 17 thereof integral with the enlarged rim portion 15, but is sufficiently thin and resilient so that when a force is exerted on the center of the flexible central portion 16, it will flex conically outwardly away from the container with the periphery 17 acting somewhat like a hinge.

At the center of the flexible central portion is a convexly conical dispensing valve member 18 having a dispensing orifice 19 in the center thereof. In a portion of the flexible central portion 16 between the periphery and the center thereof is an air return passage 20.

Held between the cover 13 and the top of the neck 11 of the container 10 is a diaphragm member 21 having an upstanding flange 22 around the periphery thereof, which serves to mount a dispensing valve body 25 in the form of a hollow stem 23 at a fixed position at the center of the neck 11. To the lower end of the hollow stem 23 is attached a liquid delivery means in the form of a dip tube 24 which extends into the container 10 to near the bottom thereof. The opposite end of the hollow stem 23 from the dip tube 24 is shaped into a conical shape which closes the end of the hollow interior **23*a* of the stem, and a plurality of product valve apertures 26 open transversely through the exterior conical surface 25*a* of the dispensing valve body 25. In a practical embodiment of the squeeze bottle dispenser according to the present invention, there can be from two to four such apertures equidistantly spaced circumferentially around the conical surface of the dispensing valve body 25. The exterior surface 25*a* of the dispensing valve body 25 is complementary in shape to the interior surface 18*a* of the dispensing valve member 18 at the center of the flexible central portion 16 of the cover 13, and the top of the conical shape projects through the dispensing orifice 19. The diaphragm member 21 further has an air flow aperture 27 therein between the hollow stem 23** and the outer periphery thereof.

Between the upstanding flange 22 and the under surface of the cover 13 is an air return valve member 28 in the shape of an annular flexible resilient member. The outer peripheral edge of the air return valve member 28 is held tightly between the upstanding flange 22 and the underside of the cover, and the inner periphery thereof is located between the air return passage 20 in the flexible central portion 16 and the dispensing valve member 18 so that the valve member covers the air return passage 20. It will be seen that the dimension of the upstanding flange 22 in the direction transverse to the plane of the diaphragm member 21 is sufficient to define between the diaphragm member 21 and the flexible central portion 16 of the cover 13 an air chamber 29.

The cover 13 is made of material similar to that of the container, and when the flexible central portion 16 flexes upwardly around the periphery 17 when pressure is exerted on it from below, the enlarged rim portion 15 is sufficiently rigid so that the rim portion 15 will remain fixed and hold the annular flexible valve 28 at the peripheral edge thereof tightly against the upstanding flange 22. The diaphragm member 21 is substantially rigid, and can be made of the same material as the container and the cover.

In operation, when the parts are at rest, as shown in FIG. 1, it will be seen that the inner surface **18*a* of the dispensing valve member 18 rests tightly against the exterior surface 25*a* of the dispensing valve body 25, thus closing and sealing the product valve apertures 26, and also sealing off the air chamber 29 from the dispensing orifice 19, and hence from the atmosphere surrounding the dispenser. The annular flexible valve 28, on the other hand, is urged against the under side of the flexible central portion 16 due to its own resilience, thus closing the air return passage 20 and sealing the air chamber 29** from the atmosphere around the container.

With the parts in these positions, when pressure is exerted on the container 10 to collapse it, for example by squeezing it between the fingers, the air in the space above the liquid L to be dispensed is compressed, and compressed air is caused to flow through the air flow aperture 27 and to increase the pressure in the air chamber 29. The resiliency of the central portion 16 is such that, when adequate pressure has built up to produce the desired degree of atomization, the increased pressure flexes the flexible central portion 16 conically upwardly around the periphery 17, while the diaphragm member 21 remains substantially fixed. Thus, the dispensing valve member 18 moves away from the dispensing valve body 25 to leave a gap which functions as an air flow passage 31 between the dispensing valve member 18 and the dispensing valve body 25 through which air flows rapidly.

The same increased pressure in the air chamber 29, on the other hand, urges the annular flexible valve member 28 more tightly against the under side of the flexible central portion 16, thus keeping the air return passage 20 closed.

The increased pressure within the resiliently collapsible container 10 is also exerted on the upper surface of the body of the liquid L to be dispensed, forcing this liquid up the dip tube 24 and through the hollow stem 23 to the apertures 26. The liquid under pressure is forced to flow through the apertures 26 substantially transversely to the exterior surface 25*a* of the dispensing valve body 25. The flow of liquid is immediately swept away by the compressed air flowing along the surface 25*a*, thus atomizing the liquid extremely well. The atomized liquid is then carried out through the dispensing orifice 19 and is dispensed from the dispenser.

When the pressure on the resiliently collapsible container is released or the compressed air which has been produced by the initial compression is used up, the pressure of the air within the air chamber 29 and the interior of the container 10 decays and eventually returns to atmospheric pressure, and then as the pressure on the under side of the flexible central portion 16 falls below the pressure necessary for good atomizing, this again flexes resiliently downwardly so as to bring the under surface 18*a* of the dispensing valve member 18 into tight contact with the exterior surface 25*a* of the dispensing valve body 25, thus closing off the air flow passage 31 and apertures 26. As the container 10 continues to expand to its normal condition, a vacuum is created within the container, and air pressure is exerted on the annular flexible valve member 28 through the air return passage 20, thus flexing the annular flexible valve member 28 away from the under surface of the flexible surface portion 16, as shown in FIG. 3. Thus, air is caused to flow into the air chamber 29 and through the air flow aperture 27 into the interior of the container 10 until the pressure within the container reaches atmospheric. At this point, the annular flexible valve member 28 will, due to its own resilience, again be resiliently pressed against the under side of the flexible central portion 16, again sealing the air return passage 20, and the parts will again be in the positions shown in FIG. 1, ready for another dispensing cycle.

Figure 4:
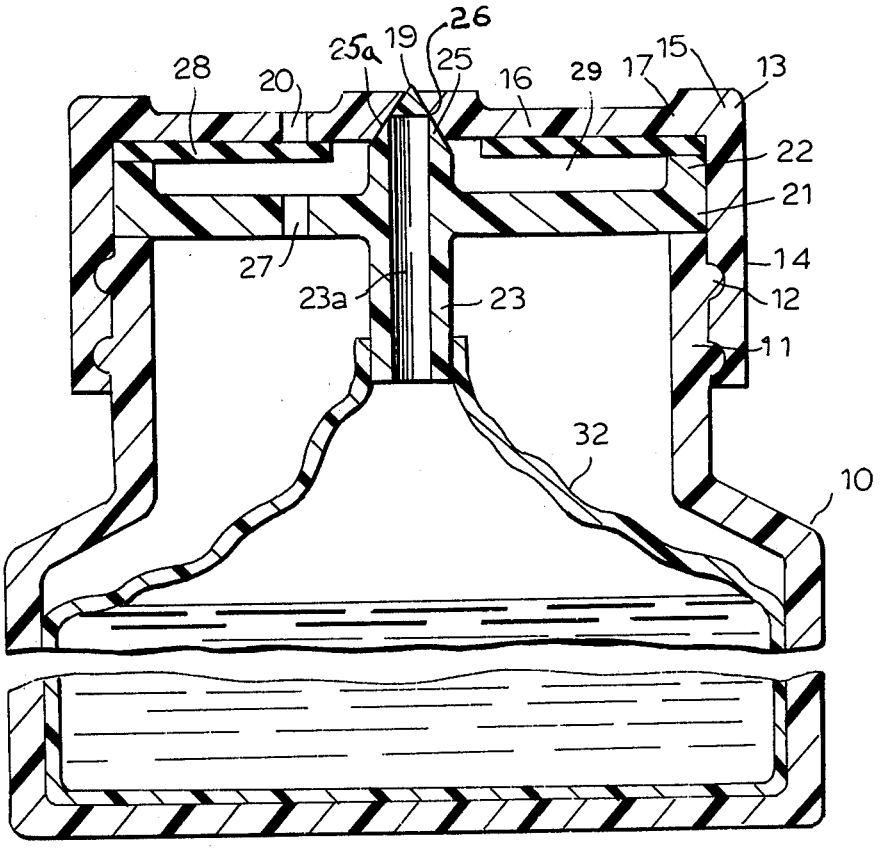
FIG. 4 is a view similar to FIG. 1 showing a second embodiment of the squeeze bottle dispenser according to the present invention.

In the embodiment of FIG. 4, the dip tube 24 is replaced with a non-resiliently collapsible bag 32 which is secured to the hollow stem 23, and which in the initial condition substantially fills about half the container 10. The operation of the dispenser of FIG. 4 is identical with that of the embodiment of FIGS. 1–3, except that each time the container 10 is pressed, liquid is forced from the bag, and when the pressure is released, the bag, instead of expanding again, remains collapsed, while air is caused to flow into the space within the container which surrounds the bag.

There are several advantages of using a bag. It makes the dispenser spillproof, and it makes it possible to operate the dispenser regardless of the position in which it is held, e.g. upside down. Moreover, the bag can be used to dispense liquids which are incompatible with the materials of the dispenser or which deteriorate when contacted by air during storage.

It will thus be seen that the device of the present invention consists only of five parts, the container, the cover, the dispensing valve body and its mounting structure, the annular flexible valve member, and either the dip tube or the collapsible bag. Nevertheless, the interior of the container is normally completely sealed from the atmosphere by the engagement of the dispensing valve member 18 with the dispensing valve body 25 and the action of valve member 28 covering air return passage 20 when the parts are at rest. A single valve means thus seals both the air flow passage through the air flow aperture 27, the air chamber 29, the air flow passage 31 and the dispensing orifice 19, as well as the liquid flow passage through the hollow stem 23, the apertures 26, the air flow passage 31 and the dispensing orifice 19. The same valve means causes buildup of pressure within the container, opening only when a pressure sufficient to produce good atomizing has been built up. Only a second annular flexible valve is needed to control the flow through the air return passage 20.

Nevertheless, the desirable effect of the air sweeping across the aperture through which the liquid is flowing to improve atomization is achieved by the dispensing valve means.

Because of the extremely simple structure and small number of parts, all of which can be easily molded in a conventional injection molding machine, the dispenser can be made very inexpensively, yet it is reliable in operation.

Spitting at the start of dispensing is avoided. When pressure is initially exerted on the collapsible container, the pressure will first build up without separating the dispensing valve member 18 from the dispensing valve body 25, and only after pressure has built to a predetermined desirable level will the valve open and the air flow passage 31 and apertures 26 open. Although air flow passage 31 and apertures 26 physically open at the same time, due to the inertia of the liquid, air will actually be flowing across apertures 26 at the time liquid flows in a significant amount. This operation takes place whether the container is squeezed rapidly or slowly. Thus, atomizing becomes independent of the way in which the operator squeezes the container.

Moreover, the dispenser is substantially self-cleaning. When the pressure on the container 10 is released, the liquid will substantially immediately stop flowing through the hollow stem 23 and apertures 26, yet there will still be sufficient compressed air flowing through the air flow passage 31 to carry away residual liquid. Moreover, there is no flow control or atomizing structure downstream of the valve in which solution can collect and the liquid evaporate and leave solute as residue. Further, since the top of the conical portion extends through the orifice 19, it will physically clear it at each operation of the device. The force for opening the valve is sufficient to break away any adhesive force tending to hold the parts of the valve together, since the large pressure area on the under side of the flexible portion is much larger than the contacting parts of the valve.

It is thought that the invention and its advantages will be understood from the foregoing description, and it is apparent that various changes may be made in the form, construction and arrangement of the parts without departing from the spirit and scope of the invention or sacrificing its material advantages, the forms hereinbefore described and illustrated in the drawings being merely preferred embodiments thereof.

What is claimed is:

1. A squeeze bottle type dispenser, comprising a resiliently collapsible container for the liquid to be dispensed, a cover means on said container, said cover means having a flexible resilient central portion flexible outwardly of the cover means away from the container under gas pressure generated in said container when said container is squeezed, a dispensing valve member on said cover having a dispensing orifice therein and an interior surface facing into said container, a dispensing valve body fixed in position within said container adjacent said cover and having an exterior surface complementary in shape to that of the interior surface of said dispensing valve member and with which the interior surface of said valve member tightly engages when the parts of the dispenser are in the non-dispensing positions, the interior of said valve body being hollow and said valve body having product dispensing apertures opening from said hollow interior through said exterior surface thereof and being normally covered by said valve member when the parts of the dispenser are in the non-dispensing positions, said dispenser having an air chamber therein surrounding the outside of said valve body and being in communication with the upper portion of the interior of said container and opening into the gap between said exterior surface of said valve body, and the interior surface of said valve member when the valve member is moved away from said valve body for permitting compressed gas from within the container to flow through said gap when the container is squeezed, said dispenser having an air return flow path therethrough and valve means in said air return flow path opening said air return flow path when the pressure on the outside of the container is greater than the pressure on the inside of the container, and liquid delivery means within said container and connected to said valve body for delivering liquid to said hollow interior of said valve body when the container is collapsed.

2. A squeeze bottle type dispenser as claimed in claim 1 in which said exterior surface of said dispensing valve body and said dispensing valve member are outwardly conical and the apex of said dispensing valve member projects through said dispensing orifice in said dispensing valve member.

3. A squeeze bottle type dispenser as claimed in claim 2 in which said product dispensing apertures are substantially transverse to the exterior surface of said dispensing valve member.

4. A squeeze bottle dispenser as claimed in claim 1 in which said air return flow path is constituted by an air return passage in said cover, and said valve means in said air return flow path is an annular resilient flexible valve member against the under side of said cover and covering said air return passage, the peripheral edge of said valve member being held between said cover and the remainder of the structure of said dispenser.

5. A squeeze bottle dispenser as claimed in claim 1 in which said liquid delivery means comprises a dip tube extending into said container from said dispensing valve body.

6. A squeeze bottle dispenser as claimed in claim 1 in which said liquid delivery means comprises a non-resiliently collapsible bag having the neck attached to said dispensing valve body.

7. A valve means for an atomized spray dispenser having a container, said valve means comprising a flexible resilient central portion flexible in a direction which, when the valve means is mounted on the container, is outwardly of the container, a dispensing valve member on said central portion and having a dispensing orifice therein and an interior surface which, when the valve means is mounted on a container, faces into the container, a dispensing valve body fixed in position on the interior surface side of said valve means and adjacent said central portion and having an exterior surface complementary in shape to that of the interior surface of said dispensing valve member and with which the interior surface of said valve member tightly engages when the parts of the valve means are in the non-dispensing positions, the interior of said valve body being hollow and said valve body having product dispensing apertures opening from said hollow interior through said exterior surface thereof and being normally covered by said valve member when the parts of the valve means are in the non-dispensing positions, said valve means having an air return flow path therethrough and a valve member therein opening said air return flow path when the pressure on the outside of the valve means, when the valve means is mounted on the container, and liquid delivery means connected to said valve body for delivering liquid from within the container to said hollow interior of said valve body.

* * * * *